United States Patent [19]

Bustos

[11] Patent Number: 4,760,928

[45] Date of Patent: Aug. 2, 1988

[54] CORRUGATED SHEET PLASTIC BEVERAGE DISPLAY CASE

[75] Inventor: Rafael T. Bustos, Alpharetta, Ga.

[73] Assignee: Leggett & Platt, Incorporated, Carthage, Mo.

[21] Appl. No.: 97,216

[22] Filed: Sep. 15, 1987

[51] Int. Cl.[4] ..... A47F 5/11

[52] U.S. Cl. ..... 211/59.4; 211/150; 248/174

[58] Field of Search ..... 211/59.4, 49.1, 150, 211/156, 133, 72; 248/174

[56] References Cited

U.S. PATENT DOCUMENTS 4,322,005 3/1982 Robertson ..... 211/150 X
4,415,090 11/1983 Bustos ..... 211/150 X
4,506,790 3/1985 Muscari ..... 211/59.4
4,646,922 3/1987 Smith ..... 211/59.4 X

*Primary Examiner*—Robert W. Gibson, Jr.
*Attorney, Agent, or Firm*—Wood, Herron & Evans

[57] ABSTRACT

A beverage display case having a back panel, side panels and a bottom panel made from corrugated sheet plastic material. The case is rigidified by a U-shaped metal rod which rests atop the top edge of the back panel and the side panels and is secured thereto by extruded plastic caps which fit over the rod and the top edge of the back panel and side panels. A pair of rigid reinforcement rods also overlie the front edge of the side panels and are secured thereto by extruded plastic caps which fit over the rods and the front edges of the side panels. An adjustable snap-up shelf is secured to the front side of the back panel.

29 Claims, 3 Drawing Sheets

CORRUGATED SHEET PLASTIC BEVERAGE DISPLAY CASE

This invention relates to beverage display cases, and more particularly, to beverage display cases for merchandising large quantities of beverage cans or bottles, as for example, 10 or 20 cases of beverage cans or bottles.

Currently, large quantity display cases for displaying and merchandising large volumes of beverage cans or bottles are made from corrugated paperboard. Typically, such paperboard display cases are shipped to a merchandiser in a flat condition, erected on site and used for one selling season or merchandising promotion period, and then discarded or thrown away because they are then too tattered and worn to be of any further use.

Corrugated paperboard display cases are typically used to display and merchandise six packs or twelve packs of beverage cans or bottles, as well as individual two-liter bottles. Two-liter bottles in particular, and to a lesser extent, six packs or twelve packs of bottles or cans, are relatively unstable when stacked in a corrugated paperboard display case. Consequently, such bottles or packages either are limited in the height to which they may be stacked in a corrugated paperboard display case or require that stabilizers, such as flat sheets of corrugated paperboard, be added to the case between each vertical layer of bottles or cans. Such flat sheets of paperboard, though, add to the expenses of the display case and interfere with access to produce stacked beneath the flat sheets of paperboard. They also are a problem because they require that the flat sheets be removed, stacked, and stored for reuse as the levels of product are removed from the case.

It has therefore been an objective of this invention to provide a large volume beverage display case which has the capacity of current corrugated cardboard cases but which is not tattered and worn looking after one selling season or promotional period and which may therefore be collapsed, stored, reassembled and reused for several selling seasons.

Still another objective of this invention has been to provide a large volume beverage display case which is more stable than corrugated plastic cases and which may therefore be stacked with product to greater heights than corrugated paperboard cases and without the need for flat sheets of removable paperboard between the layers of product.

The invention of this application which achieves these objectives comprises a display case having a back panel, a pair of side panels, and a bottom panel, all of which are manufactured from corrugated sheet plastic material. A rigid, generally U-shaped, reinforcement rod rests atop the top edge of the back panel and the side panels and is secured thereto by extruded plastic edge reinforcement caps which fit over the reinforcement rod and the top edge of the back panel and side panels. In the preferred embodiment of the invention, there are also a pair of rigid reinforcement rods overlying the front edge of the side panels and secured to the side panels by extruded plastic reinforcement caps which fit over the front edge reinforcement rods and the front edges of the side panels. To enhance the stability of stacks of cans or bottles contained in the case, there is a snap-up shelf secured to the front side of the back panel. This shelf automatically snaps up against the rear panel when all product is removed from atop it.

One advantage of this corrugated plastic display case is that it is not subject to moisture absorption and self-destruction as a result of that moisture absorption as is a corrugated paperboard case. Consequently, it is useful over a much longer period of time than a corrugated paperboard case.

Another advantage of this display case is its greater stability than prior art large volume display cases. This enhanced stability is derived from the manner in which it is constructed, i.e., with rigid rod reinforcements, and with extruded plastic caps for securing the rigid rods to the edges of the case. The snap-up shelf further contributes to stability of the case.

Yet another advantage of this corrugated sheet plastic display case is the improved graphics which may be printed and displayed on its display surfaces. Currently, displays are printed on the surfaces of corrugated paperboard display caes, but those graphics appear dull and washed out. The same graphics printed on the surface of the corrugated plastic display case of this invention are much brighter and appealing.

These and other objects and advantages of this invention will become more readily apparent from the following description of the drawings in which.

Figure 1:
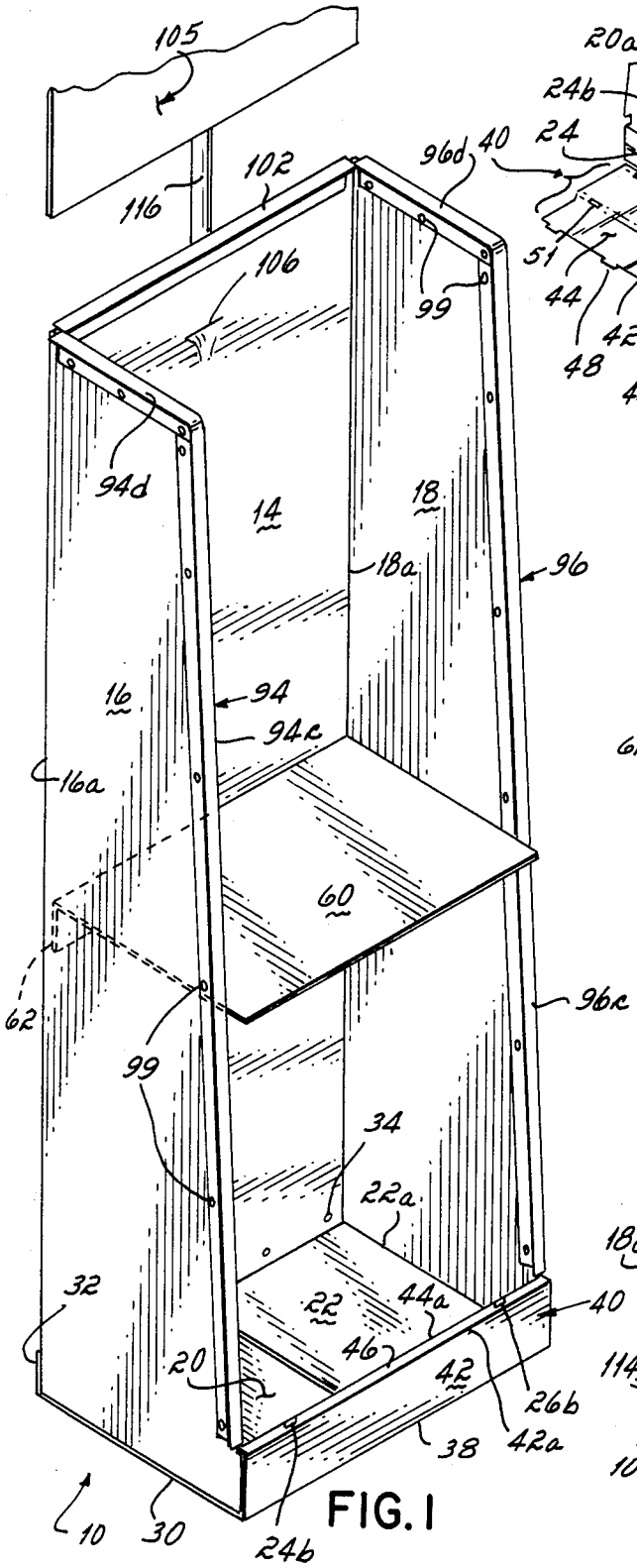
FIG. 1 is a perspective view of a display case incorporating the invention of this application.
Figure 2:
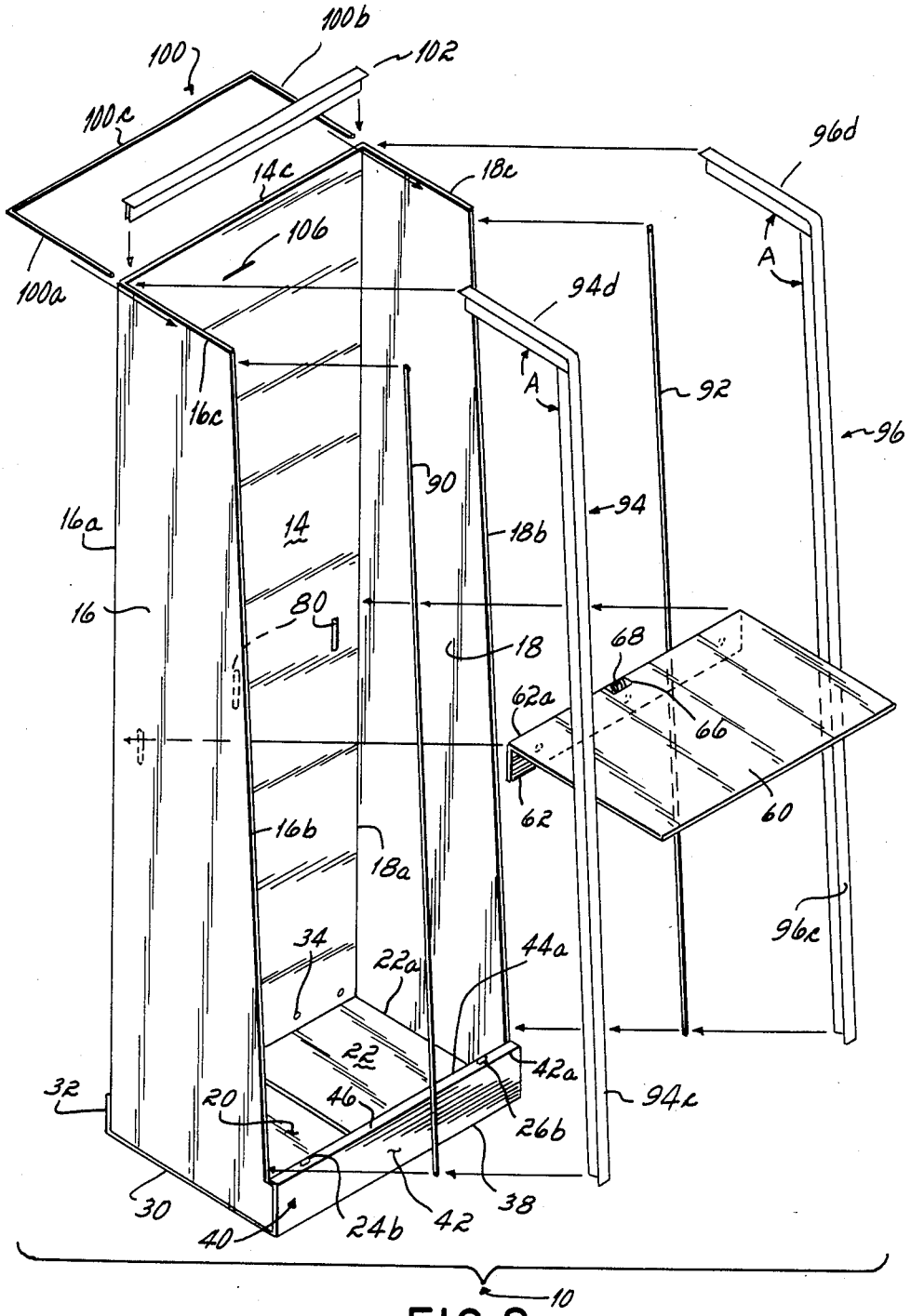
FIG. 2 is an exploded perspective view of the display case of FIG. 1.
Figures 3, 4, 5, 6:
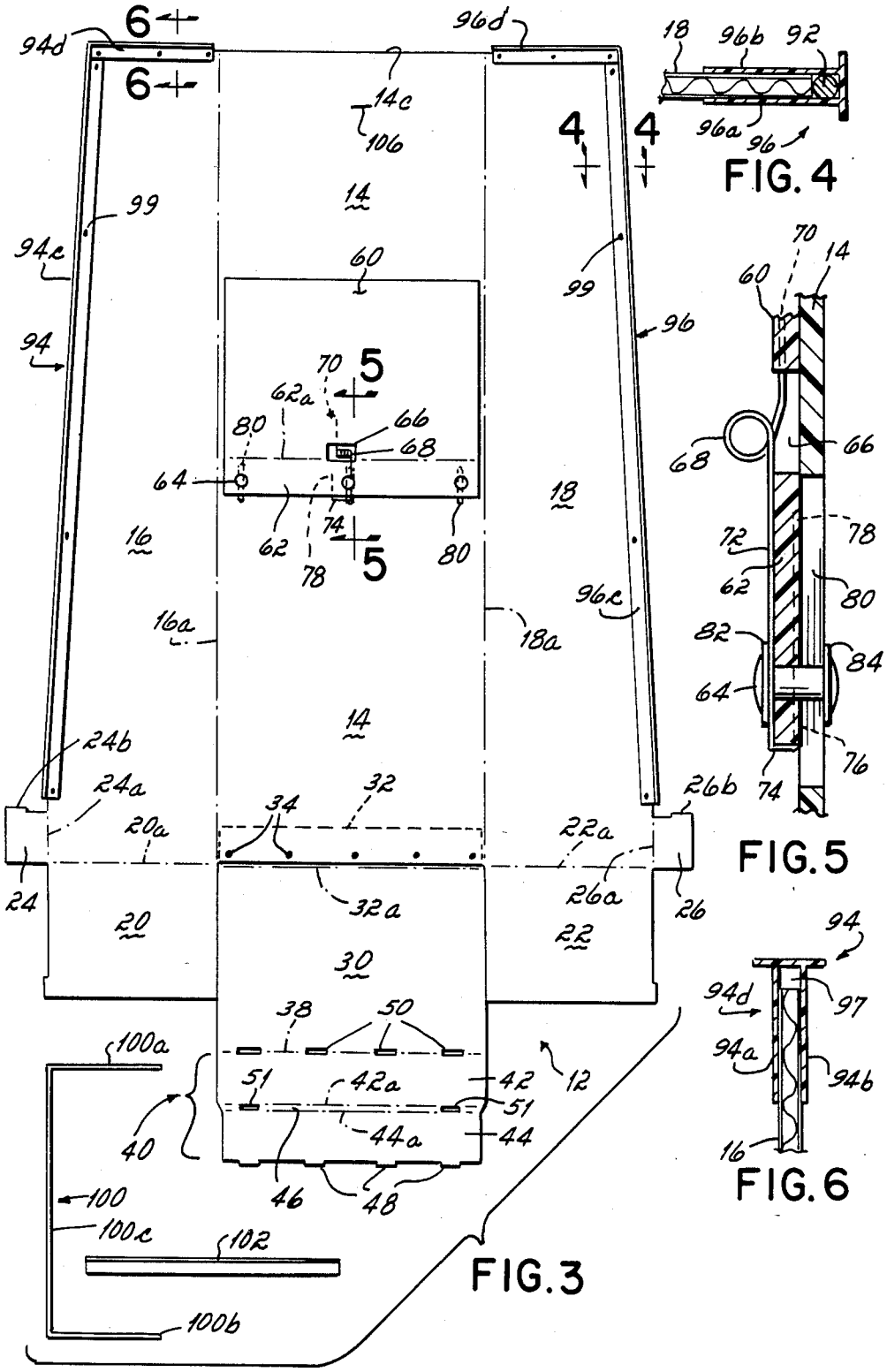
FIG. 3 is a layout of the unfolded corrugated sheet plastic blank and components from which the display case of FIG. 1 is constructed.
FIG. 4 is a cross-sectional view taken on line 4—4 of FIG. 3.
FIG. 5 is a cross-sectional view taken on line 5—5 of FIG. 3.
FIG. 6 is a cross-sectional view taken on line 6—6 of FIG. 3.

With reference first to FIGS. 1, 2 and 3, it will be seen that the major portion of the display case 10 of this invention is manufactured from a large corrugated sheet plastic blank 12. This blank 12 (FIG. 3) comprises a generally rectangular back panel 14 to which are connected by fold lines **16*a*, 18*a* a pair of side panels 16 and 18. The side panels 16 and 18 each have bottom reinforcement panels 20, 22, respectively, extending therefrom and connected to the bottom edge thereof by fold lines 20*a*, 22*a*. The side panels 16 and 18 also have ears 24, 26 extending from the lower edges thereof and connected to lower edges of the side panels 16 and 18 by fold lines 24*a*, 26*a*. The upper edge of these ears has locking tabs 24*b*, 26*b*** formed thereon to facilitate assembly of the display case, as explained more fully hereinafter.

Extending forwardly from the bottom edge of the back panel 14 there is a bottom panel 30. This panel could be formed from the same blank from which the back and side panels are formed, but in the preferred embodiment, the back panel is a separate, corrugated, plastic panel which is welded or otherwise fixedly attached to the lower edge of the back panel 14. To facilitate attachment of the bottom panel to the back panel, the bottom panel has a flap 32 formed thereon and connected to the bottom panel 30 by a fold line 32*a*. This flap is welded to the back side of the back panel 14 by conventional heat welds 34.

Connected to the front edge 38 of the bottom panel, there is double thickness front wall 40. This front wall 40 comprises a generally rectangular forward section 42 connected by the fold line 38 to the front edge of the bottom panel, and a rear section 44 connected by a pair of closely spaced parallel fold lines 42*a* and 44*a* to the top edge of the front section 42. The portion of the front panel located between the two fold lines 42*a*, 44*a* defines the top edge 46 of the double thickness front panel 40. Along its lower edge (when erected) the rear section 44 of the front panel has four locking tabs 48 depending therefrom. When the display case is erected, these locking tabs are adapted to be received within locking slots 50 cut from the bottom panel adjacent the fold line 38 between the bottom panel 30 and the front panel 40.

Attached to the front surface of the back panel 14 there is a corrugated plastic shelf panel 60. This shelf panel is generally rectangular and has a rear flap 62 connected thereto by a fold line 62*a*. This flap 62 is adjustably secured to the front surface of the back panel by rivets 64 which pass through vertical slots in the back panel.

There is a rectangular opening 66 cut from the shelf panel 60. A torsion spring 68 (FIGS. 3 and 5) is received within this cutout or opening. This torsion spring 68 has one end 70 extending upwardly and received within a channel defined by the corrugations of the corrugated sheet plastic shelf 60. The opposite end 72 of this torsion spring extends downwardly along the front face of the attachment flap 62 of the shelf panel, where it is captured by the center rivet 64, and is then bent rearwardly, as indicated at 74, and then upwardly, as indicated at 76. The upwardly bent end 78 of the torsion spring is received within a channel defined by corrugations in the sheet plastic from which the shelf panel 62 is constructed.

As best illustrated in FIG. 5, the torsion spring 68 functions to retain the shelf panel 60 in a vertical plane wherein it contacts the front surface of the back panel 14. The shelf panel, though, can be pulled downwardly into the position illustrated in FIG. 8 against the bias of the torsion spring so as to enable cans or bottles 5 to be placed atop the shelf panel 60.

Figure 8:
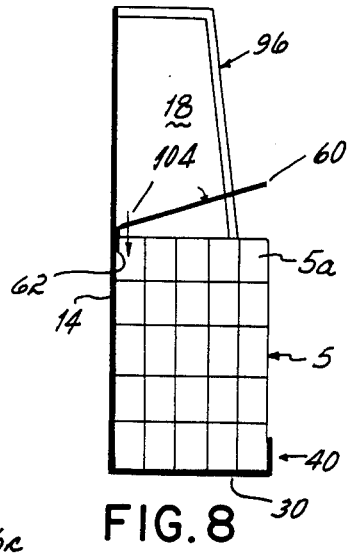
FIG. 8 is a schematic, cross-sectional view of the display case of FIG. 1 illustrating the manner in which the shelf is adjusted after placement of beverage containers within the display case.

With reference now to FIGS. 3 and 8, it will be seen that the shelf panel 60 is vertically adjustable on the back panel. To facilitate this adjustment, the rivets 64 which connect the attachment flap 62 of the shelf panel to the back panel 14 extend through slots 80 in the back panel. There are preferably washers 82, 84 located between the heads of the rivets 64 and the surface of the attachment flap 62 on the front side of the display and the back surface of the back panel 14 on the back side of the display. These washers 82, 84 prevent the rivets from pulling through the corrugated plastic material from which the shelf panel and back panel are constructed and facilitate frictional retension of the shelf panel in the position to which it is adjusted.

In the practice of this invention, the display case 10 is further stabilized and rigidified by rigid metal rods 90, 92 which overlie and are located adjacent to the front edges 16*b* and 18*b* of the side panels 16 and 18, respectively. These rods 90, 92 are retained in position overlying the edges 16*b* and 18*b* by extruded plastic caps 94, 96. With reference to FIG. 4 it will be seen that each of these extruded plastic caps is generally U-shaped in cross-sectional configuration. Each cap 94, 96 fits over the top of a rod 90, 92, respectively, and has side walls 96*a*, 96*b*, 94*a* and 94*b* which contact opposite sides of the side panels 16, 18, respectively.

At the upper end, each of the extruded plastic caps 94, 96 is cut and bent at an obtuse angle A to the lower section 94*c*, 96*c* whereby the caps 94, 96 have a straight lower section 94*c*, 96*c* and a straight upper section 94*d*, 96*d* angled relative thereto. The straight upper sections 94*d*, 96*d* of the caps 94, 96 fit over the upper edges 16*c*, 18*c* of the side panels 16 and 18 and define a gap 97 between the top of the cap and the top edge of the side panels. As explained more fully hereinafter, this gap is provided for the reception of a reinforcing rod 100.

The side walls 94*a*, 94*b*, 96*a* and 96*b* of the caps 94, 96 are preferably welded by conventional heat welds 99 to the side walls of the side panels 16 and 18, respectively.

Figure 7:
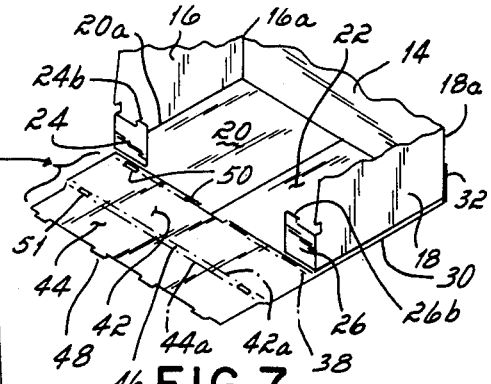
FIG. 7 is a perspective view of the bottom portion of the display case of FIG. 1 but with the front panel unfolded.

In order to assemble the display case 10 from the flat die-cut blank 12, which is usually shipped or stored in the unfolded condition illustrated in FIG. 3, the side panels 16 and 18 are first folded inwardly about the fold lines 16*a*, 18*a*, respectively. Simultaneously, the bottom reinforcement panels 20 and 22 are folded upwardly about the fold lines 20*a* and 22*a*, while the ears 24, 26 on the sides of the side panels are folded inwardly about their respective fold lines 24*a*, 26*a*. The bottom panel 30 is then folded upwardly about the fold line 32*a* and the front panel 40 then formed by folding the rear section 44 of the front panel about the fold lines 42*a*, 44*a*, and the front section 42 of the front panel 40 about the fold line 38. The locking tabs 48 on the lower edge of the rear section 44 of the front panel 40 are then inserted into the locking slots 50 of the bottom panel, and simultaneously, the locking tabs 24*b*, 26*b* of the ears 24, 26 are inserted into locking slots 51 in the top edge 46 of the front panel (see FIG. 7). Thereby, the display case is formed into the configuration illustrated in FIG. 1. To retain the display case in that configuration and to prevent the side panels from falling outwardly, particularly at the upper end, a generally U-shaped metal reinforcement rod 100 and reinforcement cap 102 is provided. The generally U-shaped reinforcing rod 100 has a pair of side legs 100*a*, 100*b* which fit within the gap 97 between the open ends of the extruded plastic upper edge sections 94*d*, 96*d* of the reinforcing caps 94, 96 and top edges 16*c*, 18*c*. When inserted into the open ends, the side legs 100*a*, 100*b* of the reinforcing rods 100 overlie the upper edges 16*c* and 18*c* of the side panels and are secured to the upper ends of the side panels by the upper ends of the reinforcing caps 94, 96.

When the side legs of the generally U-shaped reinforcing rod 100 are fully inserted into the open ends of the upper end sections 94*b*, 96*b* of the reinforcing caps 94, 96, the connecting crossbar section 100*c* of the reinforcing rod overlies the upper edge 14*c* of the back panel. The crossbar section 100*c* of the reinforcing rod 100 is secured to the upper edge of the back panel 14 by the extruded plastic cap 102. This cap is of the same cross-sectional configuration as the extruded plastic caps 94, 96, and as illustrated in FIG. 1, fits over the top edge of the back panel so as to secure the crossbar section of the reinforcing rod 100 to the back panel 14.

With the U-shaped reinforcing rod 100 in place and secured to the upper edge of the side panels and back panel, the reinforcing rod ensures that the there is no tendency for the upper edge of the side panels to spread apart, particularly at their forward ends as would be case if there were no reinforcing rod to prevent that spreading.

With reference now to FIG. 8 it will be seen that after the display case 10 has been fully assembled, the product, such as beverage cans or bottles 5, may be loaded into the display case through the open front side thereof. In practice, the display case 10 is loaded with product, such as beverage cans 5, up to a level near the level of the fold line *62a* of the shelf panel 60. The shelf panel is then adjusted in height as indicated by the arrow 104 of FIG. 8 by pushing downwardly on the top surface of the shelf until the shelf is sitting on the top of all the beverage containers 5 in the then top layer *5a* of containers in the display case. After the height of the shelf has been thus adjusted, product 5 may be placed in layers atop that shelf until the layers stack to the height of the top of the display case.

Figure 9:
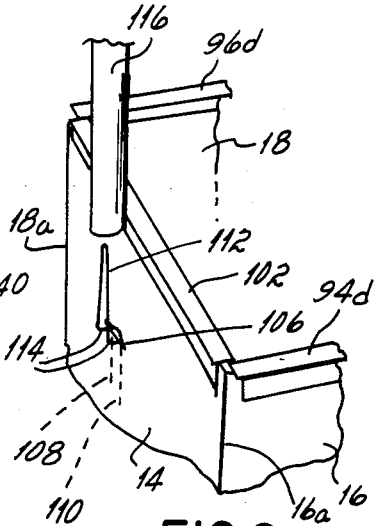
FIG. 9 is a perspective view of the back of the display case illustrating the manner in which a cylindrical display pole is attached to the back of the display case.

In the use of the display case 10, it is often desirable to add to the display case a pole mounted graphic 105, as for example, a graphic display or advertisement for a product. As may be seen in FIG. 9, such pole mounted graphics may be easily attached to the display case of this invention. All that is required is to cut a horizontal slot in the back panel 14 and to insert the opposite ends of a generally U-shaped wire 112 into vertical corrugations of the back panel. The corrugations of the back panel extend vertically and are available for insertion of the ends 108, 110 of the U-shaped wire into the open ends of those corrugations defined by the cut slot 106. The U-shaped wire 112 is horizontally offset at 114 between the upper U-shaped section and the downwardly extending ends 108, 110 so that the U-shaped upper section is spaced outwardly away from the rear surface of the back panel 14 and the offset portions 114 of the wire rest atop the edge of the horizontal slot 106. A cylindrical tube 116, such as a cardboard tube, may then simply be placed over the top of the U-shaped bent upper end section 112 of the wire, and the bottom edge of the tube will rest on the top of the offset section 114 of the wire. Any form of graphics, such as a sign board, may then be attached to the upper end of the cardboard tube 116.

There are many advantages to the display case described hereinabove. It is much more sturdy and durable than corrugated cardboard cases. Because of this durability, it may be used and reused while still being capable of being stored in a flat condition when not in use. It also has the advantage over conventional corrugated cardboard cases of being printable with graphics, which are much better defined and exhibit more brilliant colors, than is possible with corrugated cardboard.

While I have described only a single preferred embodiment of my invention, persons skilled in the art to which this invention pertains will appreciate numerous changes and modifications which may be made without departing from the spirit of my invention. Therefore, I do not intend to be limited except by the scope of the following appended claims:

I claim:

1. A beverage display case comprising a back panel, a pair of side panels, and a bottom panel, all of said panels being manufactured from a corrugated sheet plastic material, said side panels being connected to and extending forwardly from opposite side edges of said back panel, and said bottom panel being connected to and extending forwardly from a bottom edge of said back panel, a rigid, generally U-shaped, top reinforcement rod having a pair of side legs and a crossbar extending between said side legs, one of said side legs of said top reinforcement rod overlying an upper edge of each of said side panels and said crossbar of said top reinforcement rod overlying an upper edge of said back panel, and an extruded plastic edge reinforcement cap secured over said U-shaped top reinforcement rod and said upper edge of said side and back panels so as to secure said rod and said upper edges of said side and back panels in an assembled relationship.

2. The beverage display case of claim 1 wherein said extruded plastic cap is generally U-shaped in cross section and contacts opposite side walls of said side and back panels.

3. The beverage display case of claim 2 wherein said extruded plastic cap is welded to opposite side walls of said side and back panels.

4. The beverage display case of claim 1 which further includes a pair of rigid, front edge reinforcement rods, one of said front edge reinforcement rods overlying the front edge of said side panels, and a pair of extruded plastic, front edge reinforcement caps, one of said front edge reinforcement caps being secured over each of said front edge reinforcement rods and said front edge of one of said side panels.

5. The beverage display case of claim 4 wherein said extruded plastic cap is generally U-shaped in cross section and contacts opposite side walls of said side and back panels.

6. The beverage display case of claim 5 wherein said extruded plastic cap is welded to opposite side walls of said side and back panels.

7. The beverage display case of claim 1 which further includes a front panel connected by a fold line to a front edge of said bottom panel, said front panel having a front section and a rear section connected by a folded top edge, said rear section of said front panel having locking tabs on the lower edge thereof received within locking slots of said bottom panel.

8. The beverage display case of claim 7 which further includes a bottom reinforcement panel connected by a fold line to a lower edge of each of said side panels, each of said bottom reinforcement panels resting atop a top surface of said bottom panel.

9. The beverage display case of claim 1 which further includes a snap-up shelf, said shelf having a rear flap section secured to said back panel and a shelf section connected to said rear flap section by a fold line, said rear flap section and said shelf section being formed of corrugated sheet plastic material, and a torsion spring having one end secured to said rear flap section and an opposite end secured to said shelf section, said torsion spring being operable to bias said shelf section into a vertical orientation contacting said back panel.

10. A beverage display case comprising a back panel, a pair of side panels, and a bottom panel, all of said panels being manufactured from a corrugated sheet material, said side panels being connected to and extending forwardly from opposite side edges of said back panel, and said bottom panel being connected to and extending forwardly from a bottom edge of said back panel, a rigid, generally U-shaped, top reinforcement rod having a pair of side legs and a crossbar extending between said side legs, one of said side legs of said top reinforcement rod overlying an upper edge of one of said side panels and said crossbar of said top reinforcement rod overlying an upper edge of said back panel, and an extruded plastic edge reinforcement cap secured over said U-shaped top reinforcement rod and said upper edges of said side and back panels so as to secure said rod and said upper edges of said side and back panels in an assembled relationship.

11. The beverage display case of claim 10 wherein said extruded plastic cap is generally U-shaped in cross section and contacts opposite side walls of said side and back panels.

12. The beverage display case of claim 11 wherein said extruded plastic cap is welded to opposite side walls of said side and back panels.

13. The beverage display case of claim 10 which further includes a pair of rigid, front edge reinforcement rods, one of said front edge reinforcement rods overlying the front edge of each of said side panels, and a pair of extruded plastic, front edge reinforcement caps, one of said front edge reinforcement caps being secured over each of said front edge reinforcement rods and said front edge of one of said side panels.

14. The beverage display case of claim 13 wherein said extruded plastic cap is generally U-shaped in cross section and contacts opposite side walls of said side and back panels.

15. The beverage display case of claim 14 wherein said extruded plastic cap is welded to opposite side walls of said side and back panels.

16. The beverage display case of claim 10 which further includes a front panel connected by a fold line to a front edge of said bottom panel, said front panel having a front section and a rear section connected by a folded top edge, said rear section of said front panel having locking tabs on the lower edge thereof received within locking slots of said bottom panel.

17. The beverage display case of claim 16 which further includes a bottom reinforcement panel connected by a fold line to a lower edge of each of said side panels, each of said bottom reinforcement panels resting atop a top surface of said bottom panel.

18. The beverage display case of claim 10 which further includes a snap-up shelf, said shelf having a rear flap section secured to said back panel and a shelf section connected to said rear flap section by a fold line, said rear flap section and said shelf section being formed of corrugated sheet material, and a torsion spring having one end secured to said rear flap section and an opposite end secured to said shelf section, said torsion spring being operable to bias said shelf section into a vertical orientation contacting said back panel.

19. A beverage display case comprising a display case blank made from corrugated sheet plastic material, said blank comprising a back panel and a pair of side panels, each of said side panels being connected by a fold line to a side edge of said back panel, a bottom panel, said bottom panel being connected to and extending forwardly from a bottom edge of said back panel, a rigid, generally U-shaped, top reinforcement rod having a pair of side legs and a crossbar extending between said side legs, one of said side legs of said top reinforcement rod overlying an upper edge of one of said side panels and said crossbar of said top reinforcement rod overlying an upper edge of said back panel, and an extruded plastic edge reinforcement cap secured over said U-shaped top reinforcement rod and said upper edges of said side and back panels so as to secure said rod and said upper edges of said side and back panels in an assembled relationship.

20. The beverage display case of claim 19 wherein said extruded plastic cap is generally U-shaped in cross section and contacts opposite side walls of said side and back panels.

21. The beverage display case of claim 20 wherein said extruded plastic cap is welded to opposite side walls of said side and back panels.

22. The beverage display case of claim 19 which further includes a pair of rigid, front edge reinforcement rods, one of said front edge reinforcement rods overlying the front edge of each of said side panels, and a pair of extruded plastic, front edge reinforcement caps, one of said front edge reinforcement caps being secured over each of said front edge reinforcement rods and said front edge of one of said side panels.

23. The beverage display case of claim 22 wherein said extruded plastic cap is generally U-shaped in cross section and contacts opposite side walls of said side and back panels.

24. The beverage display case of claim 23 wherein said extruded plastic cap is welded to opposite side walls of said side and back panels.

25. The beverage display case of claim 19 which further includes a front panel connected by a fold line to a front edge of said bottom panel, said front panel having a front section and a rear section connected by a folded top edge, said rear section of said front panel having locking tabs on the lower edge thereof received within locking slots of said bottom panel.

26. The beverage display case of claim 25 which further includes a bottom reinforcement panel connected by a fold line to a lower edge of each of said side panels, each of said bottom reinforcement panels resting atop a top surface of said bottom panel.

27. The beverage display case of claim 19 which further includes a snap-up shelf, said shelf having a rear flap section secured to said back panel and a shelf section connected to said rear flap section by a fold line, said rear flap section and said shelf section being formed of corrugated sheet plastic material, and a torsion spring having one end secured to said rear flap section and an opposite end secured to said shelf section, said torsion spring being operable to bias said shelf section into a vertical orientation contacting said back panel.

28. A beverage display case comprising a back panel, a pair of side panels, and a bottom panel, all of said panels being manufactured from a corrugated sheet material, said side panels being connected to and extending forwardly from opposite side edges of said back panel, and said bottom panel being connected to and extending forwardly from a bottom edge of said back panel, said back panel having corrugations extending vertically in said back panel, a horizontal slot in said back panel, said slot defining spaced horizontal edges of said back panel, a generally inverted, U-shaped wire having a pair of vertical legs connected at the upper ends thereof, said legs each having a horizontal offset section located medially of the vertical height of said legs, and the lower ends of said legs being inserted through said horizontal slot of said back panel and into spaced vertical corrugations of said back panel, said offset sections of said vertical legs contacting and resting atop an edge of said back panel formed by said slot.

29. The beverage display case of claim 28 which further includes a tube located over said U-shaped wire, said tube having a lower edge resting against said horizontal offset sections of said vertical legs of said wire.

* * * * *